US011242197B2

(12) United States Patent
Lee

(10) Patent No.: US 11,242,197 B2
(45) Date of Patent: Feb. 8, 2022

(54) COLLAPSIBLE CONTAINER

(71) Applicant: Jeffrey Lee, Mapleton, UT (US)

(72) Inventor: Jeffrey Lee, Mapleton, UT (US)

( * ) Notice: Subject to any disclaimer, the term of this patent is extended or adjusted under 35 U.S.C. 154(b) by 69 days.

(21) Appl. No.: 16/022,243

(22) Filed: Jun. 28, 2018

(65) Prior Publication Data

US 2020/0002087 A1 Jan. 2, 2020

(51) Int. Cl.
*B65F 1/00* (2006.01)
*B65F 1/06* (2006.01)
*B65F 1/16* (2006.01)

(52) U.S. Cl.
CPC ..... *B65F 1/002* (2013.01); *B65F 1/06* (2013.01); *B65F 1/1615* (2013.01); *B65F 2220/106* (2013.01); *B65F 2250/114* (2013.01)

(58) Field of Classification Search
CPC ..... B65F 1/002; B65F 1/06; B65F 2220/106; B65D 33/007
USPC ..... 220/9.2, 9.3; 383/2, 36, 33, 35
See application file for complete search history.

(56) References Cited

U.S. PATENT DOCUMENTS 4,558,796 A 12/1985 Jaicks
4,666,054 A 5/1987 Jaicks
4,977,941 A * 12/1990 Henderson ..... A45C 3/00 150/112
5,072,850 A 12/1991 Gagnon
5,150,810 A * 9/1992 Loebbert ..... B65D 33/02 220/790
5,964,533 A 10/1999 Ziglar
6,062,412 A 5/2000 Jacobsmeyer, Jr.
6,250,492 B1 * 6/2001 Verbeek ..... B65F 1/06 220/495.08
7,153,025 B1 * 12/2006 Jackson ..... A45C 7/0059 383/2
7,926,702 B2 * 4/2011 Childs ..... A45C 11/00 229/87.19
2003/0106895 A1 * 6/2003 Kalal ..... B65D 21/086 220/9.2
2003/0201273 A1 * 10/2003 Reid ..... A45C 11/24 220/694
2005/0017010 A1 * 1/2005 Siegel ..... B65B 67/1233 220/495.06
2005/0281488 A1 * 12/2005 Cawley ..... B65D 33/007 383/33
2008/0056625 A1 * 3/2008 Stanton ..... B65F 1/0006 383/104
2011/0174811 A1 7/2011 Sabounjian
2013/0156350 A1 * 6/2013 Turner ..... B65F 1/002 383/12
2014/0147058 A1 5/2014 Magana
2014/0233865 A1 8/2014 Digiorgio
2016/0052710 A1 2/2016 Butler et al.
2016/0107836 A1 4/2016 Kirby
2017/0144835 A1 5/2017 Butler et al.

* cited by examiner

*Primary Examiner* — Robert Poon
(74) *Attorney, Agent, or Firm* — Amy Fiene PC

(57) ABSTRACT

A collapsible container has a collar that extends above the top opening and attaches at peripheral edges to a panel by a separable fastener.

20 Claims, 8 Drawing Sheets

COLLAPSIBLE CONTAINER

BACKGROUND

When venturing out into the great outdoors, campers are often surrounded by wildlife. It is known that wild animals, such as raccoons, bears, coyotes, and the like, in search of food, can be quite cunning at gaining access to storage containers that hold edibles. Removing lids from garbage containers at night, campers wake up to the contents within the containers strewn all around a campsite. It is desirable to safely contain food contents without concern regarding hungry animals and their nightly scavenger hunts.

Moreover, people need to have portable containers for storing waste, whether it be a day trip out near seaside or an afternoon picnic at the park. Trash receptacles are not always convenient to access or located nearby. Once the trash is obtained in the container, it is desirable to be able to transport it to a regular trash can. This may require transporting it in a vehicle or carrying it a long distance.

What is needed is a secure waste container that is easily transportable.

SUMMARY

An exemplary collapsible container comprises a hollow structure having a top opening and a closed bottom. A collar is attached at a first end to circumferential edges of the top opening, the collar extending above the top opening generally parallel to a longitudinal axis of the structure to a second end. A generally flat, round panel is attached by a linear, separable fastener along most of a circumferential edge to an edge of the second end of the collar to thereby reversibly close the top opening of the structure. A stiffener is circumferentially wrapped around sidewalls of the structure, the stiffener configured to support a shape of the structure and flexible along a longitudinal axis to permit collapse of the cylinder by bringing the top opening and closed bottom together.

Another exemplary collapsible container comprises a cylindrical container that has a wire spiral member circumferentially disposed around sides of the container. The wire spiral member wraps around walls of the cylindrical container and is configured to support a cylindrical shape, the container and panel having a flexible construction. A flexible outer collar is attached at a bottom end at or near circumferential edges on the top of the container, the collar extending parallel to a longitudinal axis of the container. A generally flat, round panel is configured to be removably attached at ends to free ends of the collar and thereby close off the top opening of the cylindrical container.

DETAILED DESCRIPTION

The following discloses a collapsible container that may be removably closed at a top opening and collapsed for easy portability.

An exemplary collapsible container comprises a hollow structure having a top opening and a closed bottom. A collar is attached at a first end to circumferential edges of the top opening, the collar extending above the top opening generally parallel to a longitudinal axis of the structure to a second end. A generally flat, round panel is attached by a linear, separable fastener along most of a circumferential edge to an edge of the second end of the collar to thereby reversibly close the top opening of the structure. A stiffener is circumferentially wrapped around sidewalls of the structure, the stiffener configured to support a shape of the structure and flexible along a longitudinal axis to permit collapse of the cylinder by bringing the top opening and closed bottom together.

Another exemplary collapsible container comprises a cylindrical container that has a wire spiral member circumferentially disposed around sides of the container. The wire spiral member wraps around walls of the cylindrical container and is configured to support a cylindrical shape, the container and panel having a flexible construction. A flexible outer collar is attached at a bottom end at or near circumferential edges on the top of the container, the collar extending parallel to a longitudinal axis of the container. A generally flat, round panel is configured to be removably attached at ends to free ends of the collar and thereby close off the top opening of the cylindrical container.

An exemplary container has a hollow structure sidewalls, closed bottom, and open top. The container includes a stiffening member that supports sidewalls of the container and also allows the container to be compressed or compacted for easy storage and portability when not in use. The container further includes a panel that closes off the top opening. A closure mechanism removably seals the panel to edges of the collar so as to allow the container to be used and sealed with ease and efficiency.

The container is advantageous for several reasons. For example, there is no handling of the garbage bag required between use and storage. The collar may be positioned downward to provide open access to the top opening of the container when desired for use and the collar may be positioned facing upward for sealing the container when desired for no use. Attaching the collar at one end to a location below the top opening provides a space around the container that is between the top opening and the end of the collar in which ends of a garbage bag may be attached to the sides of the container. This allows a garbage bag to remain folded over circumferential edges of the top opening whether the container is open or closed. With simple maneuvering, the container may be opened and sealed.

Figure 1:
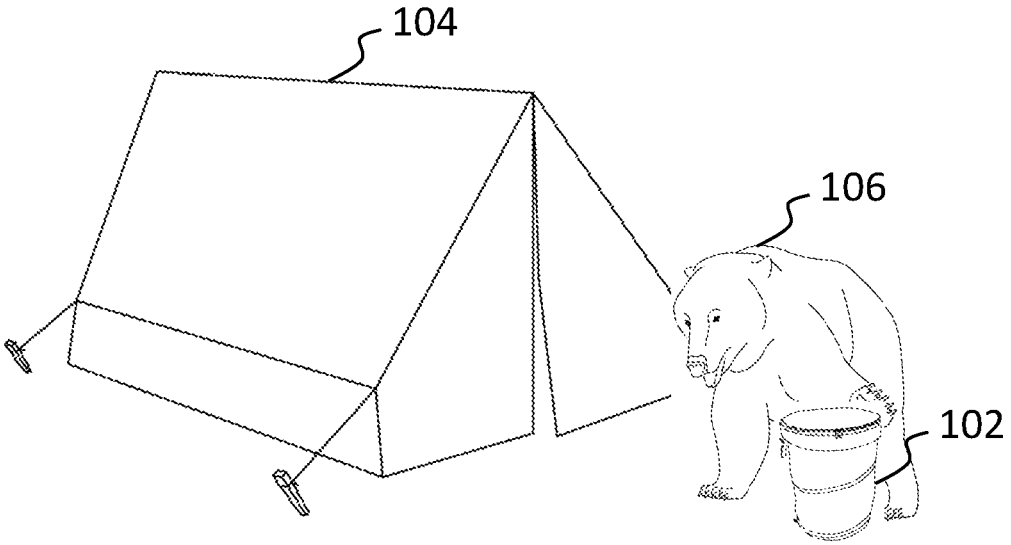
FIG. 1 shows a tent and a bear near a waste container.

Turning to FIG. 1, a camp scenario is presented with a collapsible container 102 outside a tent 104. A wandering bear 106 scavenging for food sneaks into the campground. The portable container 102 is resistant to being opened because it is sealed off. The bear 106 might not even notice the container 102 because the sealed off opening of the container 102 prevents odors from escaping which might otherwise attract bears and other wildlife.

Figure 2:
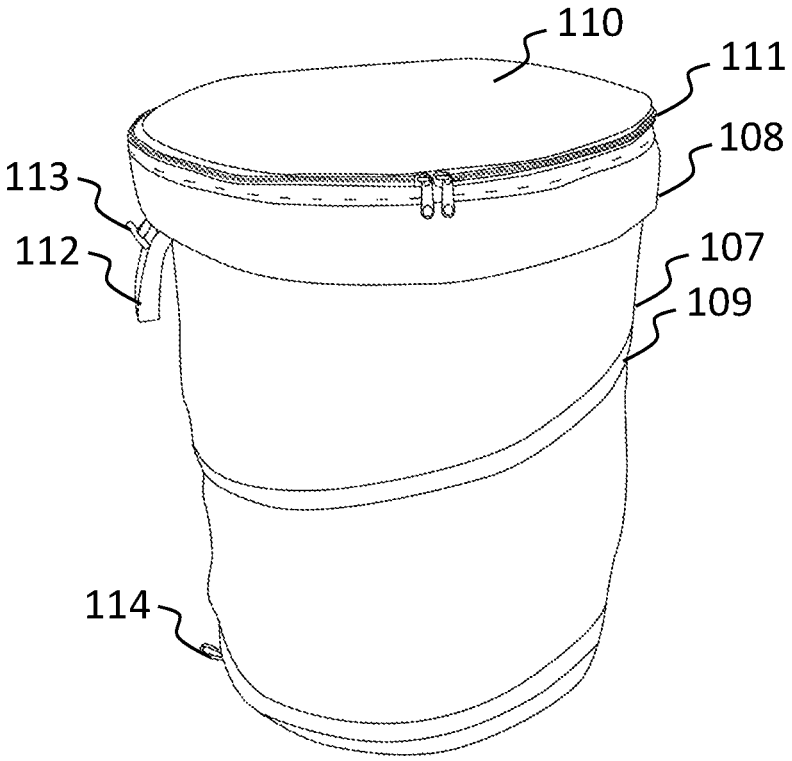
FIG. 2 shows a perspective view of a collapsible container.

Turning to FIG. 2, an exemplary collapsible container 102 is shown that includes a panel 110, cylinder 107, collar 108, spiral wire 109, zipper 111, handle 112, dongle 113, and loop 114.

The structure is shown as a cylinder 107 with a circular cross-section, however, the cross-section may also be ovoid, square, or any suitable closed shape. The structure may be cuboid, trapezoid, a three-dimensional polyhedron, or structure which consists of a collection of polygons joined as their edges with an open top.

The structure has sidewalls, which are comprised of a flexible material. A stiffener is used to support the structure in an upright position. A plurality of stiffeners may be used at various points around the structure. An accordion shape or folding shape may be incorporated. As shown, the exemplary stiffener comprises a spiral-shaped wire 109 that is circumferentially disposed around sidewalls of the structure. The wire 109 may be attached on inner facing surfaces or outer facing surfaces of the sidewalls of the structure. The wire may alternatively be layered between an inner facing surface layer and an outer facing surface layer. The stiffener, such as the wire 109 shown, is flexible along the longitudinal axis to permit collapse of the cylinder 107 by bringing the top opening and closed bottom together. The stiffener may be made of plastic, metal, rigid, or semi-rigid materials.

The bottom of the structure is closed, which may be by a base, or lower panel of the same or different material, as the structure, and be flexible, rigid, or semi-rigid.

A collar 108 comprises a wide strip of material that is attached circumferentially around sidewalls of the container. The material may be of the same material or of a different material from the rest of the container. The collar 108 may have properties that include one or more of being stiff, flexible, and pliable. The collar 108 is attached at a first end at or below circumferential edges of the top opening.

The collar 108 extends above the top opening generally parallel to a longitudinal axis of the structure to a second end. The collar 108 extends farther than upper edges of the container 102 such that a garbage bag placed within the container with ends of the garbage and folded over edges of the container does not extend beyond ends of the collar 108 when the collar 108 is secured with the panel. The collar may have a width of 0.05-1.0", 1.0-2.0", 2.0-4.0", 4.0-6.0", 6.0-8.0", 8.0-10.0", or 10.0-12.0". The collar may be attached at its first end to the container at a location that is 0.05-1.0", 1.0-2.0", 2.0-4.0", 4.0-6.0", 6.0-8.0", or 8.0-10.0" below the circumferential edge of the top opening.

The collar 108 may be positioned so that second ends extend toward the bottom of the container. This configuration allows the top opening of the container 102 to be more readily exposed and thus more accessible for placement of waste materials.

The panel 110 comprises a generally flat, round material that is of the same material or of a different material from the rest of the container and collar. The panel 110 is attached by a linear separable fastener along most or all of a circumferential edge to an edge of the second end of the collar 108 to thereby reversibly close the top opening of the structure. The panel 110 may be connected to at least a portion of the second ends of the collar 108 so as to fold over the top opening of the container 102 and be secured to the edges of the second end of the collar 108.

The linear separable fastener may take the form of a zipper 111 as shown. The zipper may have a slider that starts at a bottom start on one side of the container and a chain that wraps around circumferential edges to meet the bottom start. Alternatively, two sliders may start from two bottom starts located near each other on one side of the container or at the same location. Each slider follows its respective chain in opposite directions (e.g. clockwise and counterclockwise) to circle the circumferential edges and meet each other at a common location. As shown, the two sliders meet together at the front of the container.

One or more optional handles 112 are located on either side of the container to allow a user to lift the container. The handle shown comprises a loop for someone to grasp manually with their hands. Other types of handles are anticipated.

A closure mechanism secures top and bottom sides of the container 102 together to hold the container 102 in its compacted form. An exemplary closure mechanism shown includes a dongle 113 at or near the top of the container and a loop 114 located at the bottom of the container. The dongle 113 is secured to the loop 114 by passing through the hole in the loop 114 with ends of the dongle restricting movement of the dongle 113 from passing back through the hole.

Figure 3:
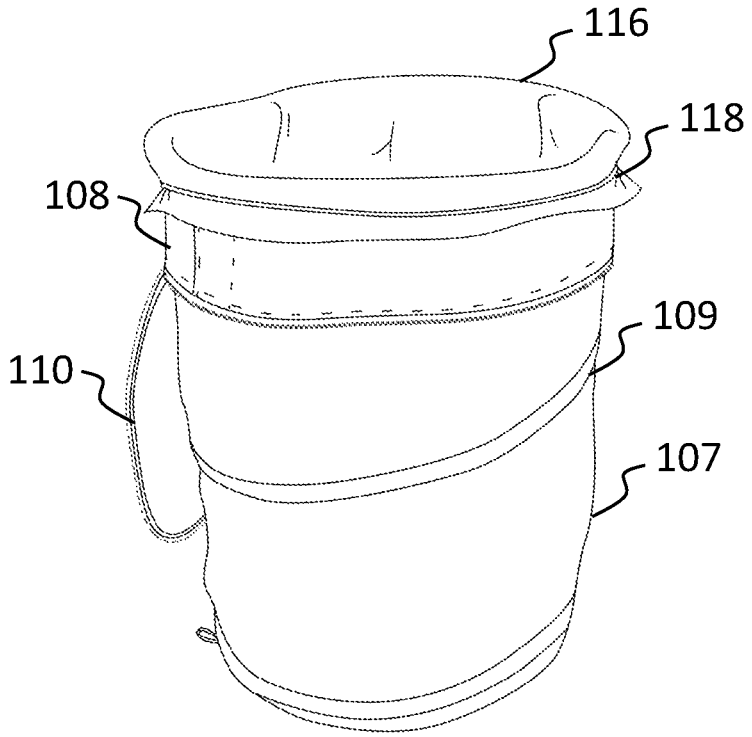
FIG. 3 shows a perspective view of a collapsible container.

Turning to FIG. 3, the panel 110 is shown folded over the side of the container 102. The collar 108 is flexible and is shown hanging downward pointing to the bottom end of the container 102. A garbage bag 116 is placed within the hollow interior of the container 102 and ends of the garbage bag 116 are folded over the top circumferential edges of the container. An elastic or tie 118 is used to secure the ends of the garbage bag 116 to sidewalls of the container and hold the bag 116 in place. Other types of securement include a band or belt or other types of securement that are known in the art.

Figure 6:
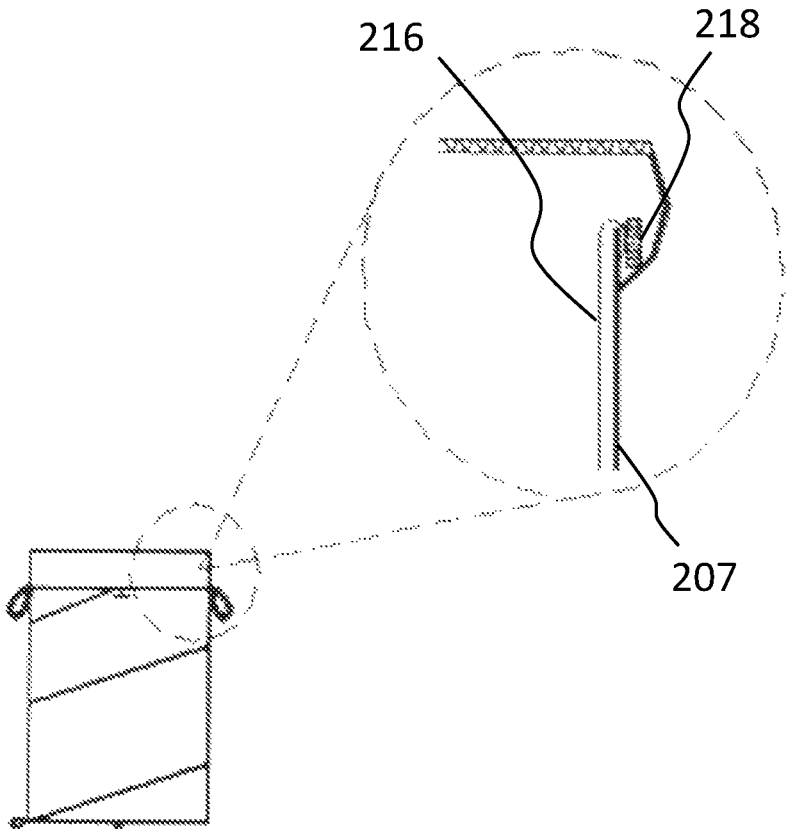
FIG. 6 shows a close-up view of a portion of the collapsible container.
Figure 8:
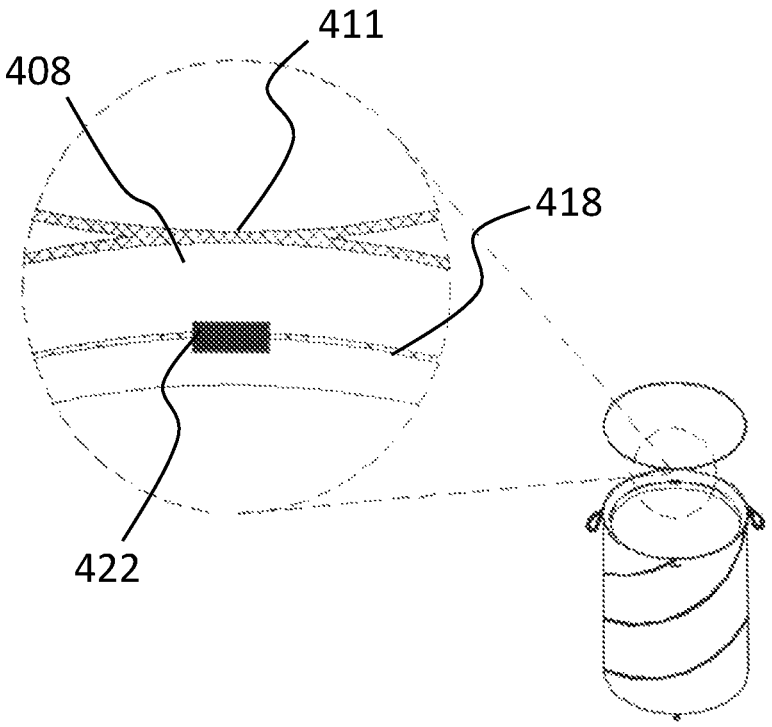
FIG. 8 shows a close-up view of a portion of the collapsible container.

In FIG. 6, an exemplary elastic 218 is shown located around top circumferential edges of the container. The elastic secures ends of the garbage bag 216 which are folded over the sidewalls of the container 207. Variations include that at least a portion of the elastic be attached to the collar or to the cylinder. FIG. 8 shows the elastic attached to the collar 418 as indicated by the black box 422. The zipper is shown at the second end of the collar 411. The elastic may be attached at any point between first and second ends of the collar 411. The elastic may be sewn, bonded, or otherwise secured to the collar. With the elastic attached to the collar, a user is more likely to not lose the elastic. Moreover, the attachment of the elastic means that the container is an all-in-one unit that stays together and transports together.

Figure 7:
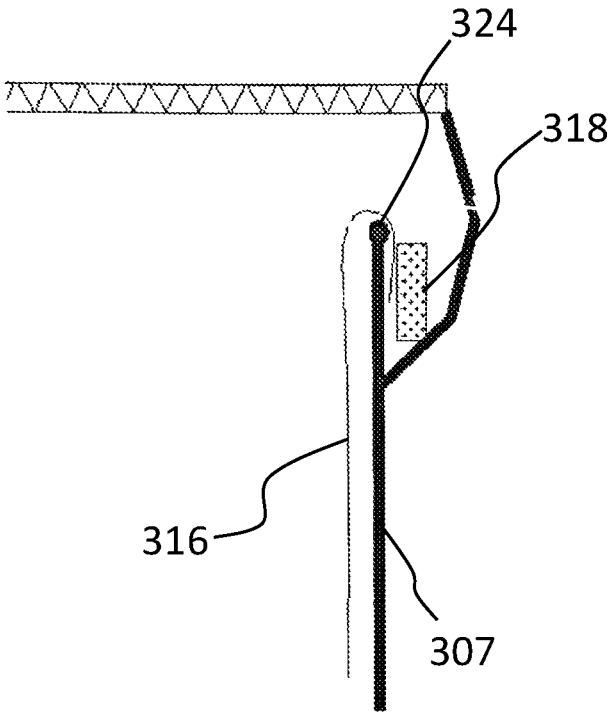
FIG. 7 shows a close-up view of a portion of the collapsible container.

In FIG. 7, a top ring 324 is shown located around top circumferential edges of the container 307. Elastic 318 secures edges of the garbage bag 316 below the top ring 324. The structure of the container can be made of flexible material, such as a plastic tarp type of material. An exemplary top and bottom of the cylinder includes a ring made of wire or plastic to form the top and bottom circumferences. The body of the cylinder includes a coil of wire wrapped around the outside, or inside, of the container to provide structural support of the tarp structure. The wire for the top, bottom, and coil are attached to together and wrapped or enveloped in canvas, plastic, or other material, and secured (e.g. sewn, bonded, etc.) to the tarp structure to form the collapsible container. The flexible properties of the container materials combined with the wire or other stiffener allow the elastic to stretch or displace the material inward relative to the ring when the elastic is disposed around the container. In this position, the elastic is resistant from coming off the top of the top opening because it pushes the material and the garbage bag underneath or otherwise inward relative to the ring.

Figure 4:
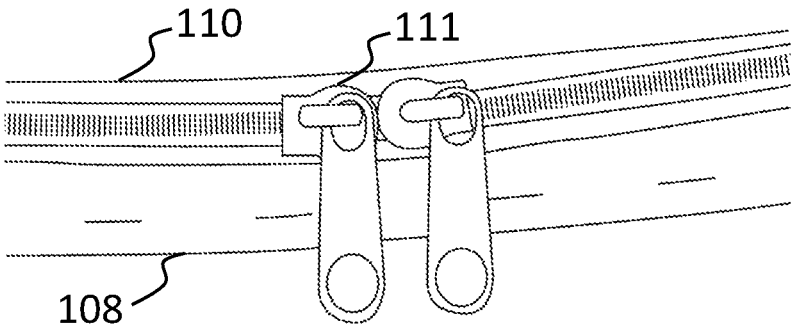
FIG. 4 shows a zipper closure.

Turning to FIG. 4, two exemplary zippers are shown, with zipper sliders 111 that connect edges of panel 110 to edges of the collar 108.

Figure 5:
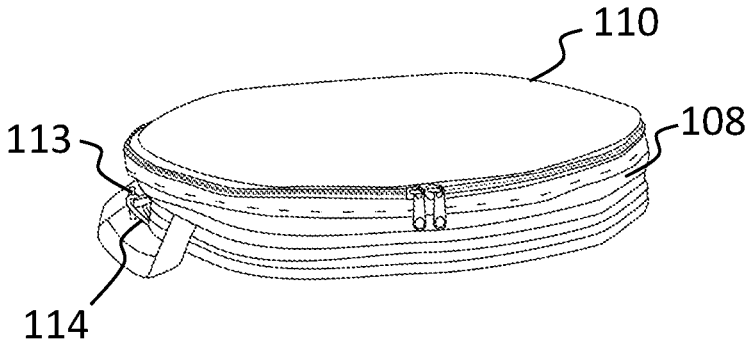
FIG. 5 shows a perspective view of a collapsible container.

Turning to FIG. 5, a closed position is shown, with sidewalls of the container 102 compacted down and held together by a loop 114 and dongle 113.

Materials for various components described herein may include one or more of plastic, vinyl, canvas, and nylon.

Note that the container may comprise an outer ridge member located at the top opening or below the top opening of the container. The outer ridge member is a ridge that extends outward or outward and then curving downward toward the bottom of the container. The outer ridge member is configured for sides of the garbage bag to be folded over. The sides may also be partially secured between the ridge and sidewalls of the container for a friction fit. An elastic or other attachment member may be used to wrap around the side of the bag and secure the bag to the sidewalls of the container underneath the ridge member.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention

What is claimed is:

1. A collapsible container comprising:

a hollow structure having a top opening and a closed bottom;

a collar having a first end and a second end, the collar attached at a first end to the structure at circumferential edges below the top opening, the collar of a flexible material such that the collar is movable from a first position where the second end of the collar extends above the top opening to a second position where the second end extends below the top opening and toward the closed bottom of the container;

a generally flat, round panel attached by a linear separable fastener along most of a circumferential edge of the panel to an edge of the second end of the collar to thereby reversibly close the top opening of the structure, a space thus provided between the top opening of the structure and the first end of the collar that is covered by the panel, the space dimensioned for edges of a bag, the bag thus being completely sealed within the container when the panel is fastened to the collar; and a stiffener that is circumferentially wrapped around sidewalls of the structure, the stiffener configured to support a shape of the structure, and flexible along the longitudinal axis to permit collapse of the structure by bringing the top opening and closed bottom together.

2. The container of claim 1, wherein the structure is made of a flexible material.

3. The container of claim 1, wherein the structure is a cylindrical shape.

4. The container of claim 1, further comprising an outer ridge member located below the top opening of the container, the outer ridge member configured for sides of a garbage bag to be folded over.

5. The container of claim 1, further comprising one or more of a tie, elastic, band, or belt that is capable of functioning to secure a garbage bag to outer sides of the container, such that when sides of the bag fold over the top opening, the one or more of the tie, elastic, band, or belt are to wrap around sides of the bag and sides of the container and thereby secure the bag to the container.

6. The container of claim 1, wherein the fastener is a zipper closure.

7. The container of claim 1, wherein the panel is connected to a portion of the second ends of the collar so as to fold over the container and be secured to the collar.

8. The container of claim 1, wherein the collar extends farther than upper edges of the container such that a garbage bag placed within the container with ends of the garbage bag folded over the container does not extend beyond the collar when the collar is secured with the panel.

9. The container of claim 1, wherein the container collapses along its longitudinal axis with the stiffener compacted, the container configured to be secured.

10. The container of claim 1, further comprising a closure mechanism that secures the container in a compacted form.

11. The container of claim 1, wherein the closure mechanism is a strap and dongle.

12. The container of claim 1, further comprising at least one handle located on a side of the container for lifting and transporting the container.

13. The container of claim 1, wherein the container comprises a generally flexible, pliable material.

14. The container of claim 1, wherein the stiffener comprises a spring-like member.

15. The container of claim 1, wherein the stiffener comprises a spiral wire member.

16. The container of claim 1, wherein the stiffener comprises one or more of plastic or metal.

17. The container of claim 1, wherein the container comprises one or more of plastic, vinyl, canvas, and nylon.

18. A collapsible container comprising:

a flexible cylindrical container having a top opening and a closed bottom;

a wire spiral member that is circumferentially disposed around sides of the container, the wire spiral member wrapping around walls of the cylindrical container and configured to support a cylindrical shape;

a flexible outer collar having a first end and a second end, the collar attached at the first end at circumferential edges below the top opening of the container, the collar being movable from a first position where the second end of the collar extends above the top opening to a second position where the second end extends below the top opening and toward the bottom of the container;

a flexible, generally flat, round panel configured to be removably attached at ends to the second end of the collar and thereby close off the top opening of the cylindrical container, a space provided between the top opening of the container and the first end of the collar that is covered by the panel, the space dimensioned for edges of a bag, the bag thus being completely sealed within the container when the panel is fastened to the collar; and wherein the container is capable of functioning with a bag, the bag to be inserted within the container, sides of the bag to fold over edges of the flexible outer collar such that the sides of the bag are substantially covered by the round panel when the round panel is attached to circumferential edges on the top of the container that are below the flexible outer collar.

19. A collapsible container comprising:

a cylindrical container having a top opening and a closed bottom;

a flexible outer collar attached at a first end below the top opening of the container, the collar being movable from a first position where a second end extends above the top opening to a second position where the second end extends below the top opening and toward the closed bottom of the container; and a generally flat, round panel configured to be removably attached to the collar and thereby close off the top opening of the cylindrical container, the panel being attached at circumferential edges to the second end of the collar by a linear, separable fastener, a space provided between the top opening of the container and the first end of the collar that is covered by the panel, the space dimensioned for edges of a bag, the bag thus being completely sealed within the container when the panel is fastened to the collar; and wherein the container is capable of functioning with a bag, the bag to be inserted within the container, sides of the bag to fold over edges of the flexible outer collar such that the sides of the bag are substantially covered by the round panel when the round panel is attached to circumferential edges on the top of the container that are below the flexible outer collar.

20. The container of claim 19, further comprising a spring-like member configured to support a cylindrical shape of the cylindrical container, and flexible along the longitudinal axis to permit collapse of the cylindrical container by bringing the top opening and closed bottom together.

* * * * *